United States Patent [19]

Parlman et al.

[11] 4,322,304

[45] Mar. 30, 1982

[54] BIS(DISUBSTITUTED AMINOMETHYL)PHENOLS AS ASHLESS HYDROCARBON ADDITIVES

[75] Inventors: Robert M. Parlman; Lyle D. Burns, both of Bartlesville, Okla.

[73] Assignee: Phillips Petroleum Company, Bartlesville, Okla.

[21] Appl. No.: 145,183

[22] Filed: Apr. 29, 1980

[51] Int. Cl.[3] ..... C10M 1/32

[52] U.S. Cl. ..... 252/51.5 R; 44/75; 252/404; 544/162

[58] Field of Search ..... 44/75; 252/51.5 R, 404; 260/570.9; 544/86, 162

[56] References Cited

U.S. PATENT DOCUMENTS

| | | | |
|---|---|---|---|
| 2,553,441 | 5/1951 | Chenicek | 260/570.9 |
| 2,696,427 | 12/1954 | Biswell | 44/75 |
| 3,280,097 | 10/1966 | Cizek | 260/570.9 |

*Primary Examiner*—Winston A. Douglas
*Assistant Examiner*—Y. Harris-Smith

[57] ABSTRACT

Ashless hydrocarbon fuel compositions comprising a hydrocarbon fuel for a combustion engine and bis(-disubstituted aminomethyl)phenol. Ashless lubricating compositions comprising a lubricating stock and bis(-disubstituted aminomethyl)phenol. Bis(disubstituted aminomethyl)phenols, particularly bis(disubstituted aminomethyl)alkyl phenols as novel compositions of matter.

16 Claims, No Drawings

BIS(DISUBSTITUTED AMINOMETHYL)PHENOLS AS ASHLESS HYDROCARBON ADDITIVES

BACKGROUND OF THE INVENTION

This invention relates to ashless hydrocarbon fuel for combustion engines. In another of its aspects this invention relates to ashless lubricating compositions. In another of its aspects this invention relates to the use of bis(disubstituted aminomethyl)phenols, particularly bis(disubstituted aminomethyl)alkyl phenols, as additives for hydrocarbon fuel and lubricating compositions. In another of its aspects this invention relates to novel compositions of matter which are bis(disubstituted aminomethyl)phenols.

Cracked gasolines, polymer gasolines and blends containing these gasolines are unstable and tend to undergo deterioration over a period of time, particularly when exposed to oxygen. This difficulty is believed to be due to the presence in the gasoline of certain undesirable constituents which are subject to oxidative changes and result in the formation of gums and color-imparting bodies. These resinous or gummy substances tend to form coatings in feed lines, parts of carburetors, valves, valve stems, etc. with the result that the gasoline is reduced in value as a motor fuel. U.S. Pat. No. 2,401,957 discloses the use of 2(dialkylaminomethyl)-4-dialkylaminophenols as stabilizers in cracked gasoline. These materials are actually diamines. U.S. Pat. No. 3,770,397 describes the use of alkali metal salts of alkyl and dialkyl aminoalkyl phenols and bis(dialkylamino)alkyl phenols as antiknock agents in liquid hydrocarbon fuels. These materials may not be completely ashless since they contain alkali metal, a potential ash component. It is of economic and practical importance to have additives that can serve as an antioxidant both in hydrocarbon fuels used for internal combustion engines and in lubricants.

It is therefore an object of this invention to provide ashless hydrocarbon fuel compositions and ashless lubricating compositions. It is another object of this invention to provide a method for producing ashless hydrocarbon fuel compositions and ashless lubricating compositions. It is still another object of this invention to provide novel compositions of matter useful as additives in hydrocarbon fuel compositions and lubricating compositions.

Other aspects, objects and the various advantages of this invention will become apparent upon reading this specification and the appended claims.

STATEMENT OF THE INVENTION

According to this invention an ashless hydrocarbon fuel composition is provided which is made up of a hydrocarbon fuel for a combustion engine and bis(disubstituted aminomethyl)phenol. In an embodiment of the invention the bis(disubstituted aminomethyl)phenol is bis(disubstituted aminomethyl)alkyl phenol.

In another embodiment of the invention an ashless lubricating composition is provided which is made up of a lubricating stock and bis(disubstituted aminomethyl)phenol. In an another embodiment of the invention the bis(disubstituted aminomethyl)phenol is bis(disubstituted aminomethyl)alkyl phenol.

In another embodiment of the invention methods are provided for producing ashless hydrocarbon fuel compositions and ashless lubricating compositions in which there are added to the hydrocarbon fuel for a combustion engine or to a lube stock an amount of bis(disubstituted aminomethyl)phenol sufficient to act as oxidation stabilizer for the composition.

In yet another embodiment of the invention bis(disubstituted aminomethyl)phenol is prepared as a novel composition of matter that is useful as an additive in ashless hydrocarbon fuel compositions or ashless lubricating compositions.

Bis(disubstituted aminomethyl)phenols useful in this invention are those compounds represented by either formula

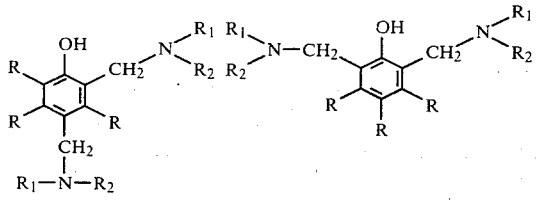

where R is hydrogen or an alkyl radical having 1 to 6 carbon atoms, $R_1$ and $R_2$ are alkyl radicals having 1 to 6 carbon atoms with the proviso that $R_1$ and $R_2$ taken together can be any alkylene or alkylene ether radical having 4 to 6 carbon atoms. In one embodiment of the invention R is only hydrogen while in another emodiment at least one R must be alkyl with the remainder of R being hydrogen. In the latter case the compounds are bis(disubstituted aminomethyl) alkylphenols. Materials that correspond to the above formulas can be, but are not limited to, such compounds as 2,4- and 2,6-bis(dimethylaminomethyl)phenol, 2,4- and 2,6-bis(diethylaminomethyl)phenol, 2,4- and 2,6-bis(di-n-propylaminomethyl)phenol, 2,4- and 2,6-bis(di-n-butylaminomethyl)phenol, 2,4- and 2,6-bis(di-n-hexylaminomethyl)phenol, 2,4-bis(dimethylaminomethyl)-6-methylphenol, 2,4-bis(dimethylaminomethyl)-5-methylphenol, 2,4-bis(dimethylaminomethyl)-3-methylphenol, 2,4-bis(dimethylaminomethyl)-5,6-dimethylphenol, 2,4-bis(dimethylaminomethyl)-3,5-dimethylphenol, 2,4-bis(dimethylaminomethyl)-3,5,6-trimethylphenol, 2,6-bis(dimethylaminomethyl)-4-methylphenol, 2,6-bis(dimethylaminomethyl)-3-methylphenol, 2,6-bis(dimethylaminomethyl)-4-isopropylphenol, 2,6-bis(dimethylaminomethyl)-4-tert-butylphenol, 2,6-bis(dimethylaminomethyl)-4-n-hexylphenol, 2,4-bis(dimethylaminomethyl)-6-isopropylphenol, 2,4-bis(dimethylaminomethyl)-6-tert-butylphenol, 2,4-bis(dimethylaminomethyl)-6-n-hexylphenol, 2,4-bis(diethylaminomethyl)-6-tert-butylphenol, 2,4-bis(diethylaminomethyl)-5-methyl-6-tert-butylphenol, 2,4-bis(piperidinomethyl)-6-methylphenol, and 2,4-bis(morpholinomethyl)-6-methylphenol and the like and mixtures thereof.

The synthesis method employed for preparing the compounds described herein is well known in the art. U.S. Pat. No. 3,770,397 describes the general synthesis method as reacting phenols or substituted phenols with formaldehyde and dialkyl amines.

When the above compounds are used as additives in unleaded gasolines, the concentration considered to be most effective when employed as an antioxidant is about 0.0001 to about 1 weight percent (1 to 10,000 parts per million), preferably about 0.0002 to about 0.5 weight percent (2 to 5,000 parts per million).

The inventive compounds described herein can also be used as antioxidant additives in other hydrocarbon-based products such as lubricating oils, greases and the like. Effective additive levels for these compositions are about 0.01 to about 10 weight percent, preferably about 0.1 to about 2 weight percent based on the amount of hydrocarbon employed.

Lubricating oils for which this invention is useful are those paraffinic lubricant stock materials having a viscosity index of about 100 and a Saybolt Viscosity at 210° F. in the range of about 39 to about 200 Saybolt Universal Seconds (SUS) preferably about 45 to about 75 SUS. Listed below are the characteristic properties of some typical lubricating oils.

Characteristic Properties of Typical Lubricating Oils

| Properties | Lubricating Oils | | | |
|---|---|---|---|---|
| | KC-10[a] | KC-20 | KC-50 | KC-250 |
| Density, 20° C., g/ml | 0.8579 | 0.8768 | 0.8876 | 0.9028 |
| Refractive Index | 1.4742 | 1.4845 | 1.4903 | 1.4990 |
| Av. Mol. Wt. (by Vapor Press. Osmometer) | 341 | 451 | 609 | 783 |
| Mol. Wt. (GPC) | 327 | 424 | 609 | — |
| Mol. Wt. Ratio, $M_w/M_n$ (GPC) | 1.1 | 1.14 | 1.21 | — |
| Viscosity (SUS) | 96.71 | 310.1 | 1421.9 | 4090 |
| 100° F. | 39.2 | 53.4 | 111.0 | 206 |
| 210° F. | — | 34.5 | 42.28 | 50.5 |
| 350° F. | — | 32.5 | 37.93 | 42.8 |
| 450° F. | — | — | 35.29 | 38.56 |
| Viscosity Index | 103 | 101 | 100 | 97 |
| % Aromatic Carbon | 4.5 | 6.0 | 6.5 | 8.5 |
| % Naphthenic Carbon | 31.0 | 29 | 26.5 | 24.5 |
| % Paraffinic Carbon | 64.5 | 65 | 67.0 | 67.0 |

[a]KC refers to Kansas City Refinery, Phillips Petroleum Co.

These lubricating oils can be used singly or as blends.

The types of hydrocarbon fuels useful in this invention are alkylate gasolines, cracked gasolines, polymer gasolines or the like. Gasolines having 0.1 to b 50 weight percent of constituents convertible into gummy resinous materials are preferred since the additive compounds of the invention provide antioxidant characteristics. The hydrocarbon fuel used in this invention is considered to be a typical unleaded gasoline. This base fuel contains little if any metals and is comprised of varying amounts of paraffins, olefin, cycloparaffins (naphthenes) and aromatics. General specifications for this type gasoline is disclosed in ASTM D 439-56T. This gasoline is generally defined as containing less than 0.05 weight percent lead. The amount of volatilizing agent employed will vary to meet specific requirements due to seasons and geographical locations. The characteristics and properties of the unleaded gasoline employed are as follows:

Characteristics of Test Gasoline

| Designation | FT-116[a] |
|---|---|
| Reid Vapor Pressure, psi | 7.0 |
| API Gravity at 60° F. (15.6° C.) | 64.4 |
| **ASTM Distillation Vol. % Evaporated** | **Temp. °F.** |
| IBP | 88 |
| 5 | 113 |
| 10 | 130 |
| 15 | 143 |
| 20 | 154 |
| 30 | 176 |
| 40 | 196 |
| 50 | 214 |
| 60 | 234 |
| 70 | 252 |
| 80 | 290 |
| 90 | 347 |
| 95 | 384 |
| EP | 414 |
| Lead Content, g/gal | 0.02 |
| Sulfur Content, wt. % | 0.28 |
| Research Octane Number (RON) | 92.0 |
| Motor Octane Number (MON) | 84.9 |
| **Component** | **Wt. %** |
| Paraffins | 68.1 |
| Olefins | 16.3 |
| Naphthenes | 4.04 |
| Aromatics | 11.55 |
| Average Molecular Weight | 100.2 |
| Atomic Ratio:Hydrogen/Carbon | 2.08 |
| Stoichiometric Air-Fuel Ratio | 14.86 |

[a]Unleaded Kansas City Premium Pipeline Base Gasoline from Phillips Petroleum Company.

The following examples serve to illustrate the operability of this invention.

EXAMPLE I

This example describes the general method of preparing noninventive mono(disubstituted aminomethyl) phenols used for comparative purposes. Into a 1000 milliliter round bottom flask equipped with a stirrer, dropping funnel and thermometer was charged 103.6 grams (0.5 moles) of 4-tertiary butylphenol, 60 milliliters (40.8 grams, 0.91 moles) of dimethylamine and 200 milliliters of water. The mixture was cooled to about 20° C. with stirring whereupon 45 grams of a 37 weight percent formaldehyde solution (0.55 moles formaldehyde) was added over a 30 minute period while maintaining the temperature between 25° C. to 30° C. The mixture was stirred for 1 hour after the addition was complete. The dropping funnel was then replaced with a reflux condenser and the solution was heated with stirring at about 90° C. for 2 hours. To the hot solution was added 40 grams of solid sodium chloride. After about 20 minutes, the top organic layer was removed for distillation under reduced pressure. The product, 2-(dimethylaminomethyl)-4-tert-butylphenol, was distilled at 77°–78° C./0.15 torr (mm). Identity was confirmed by Infrared, NMR and/or elemental analysis, Calc'd for $C_{13}H_{21}NO$: %C, 75.31; %H, 10.23; %N, 6.75. Found: %C, 75.33; %H, 10.12; %N, 6.62.

Using the same general procedure, another mono(disubstituted aminomethyl) phenol was prepared, namely, 2-(dimethylaminomethyl) phenol from phenol and dimethylamine. The compound was obtained as a crude product distilling at 77° C./0.05 mm which was analyzed. Calc'd for $C_9H_{13}NO$: %C, 71.49; %H, 8.66; %N, 9.27. Found: %C, 71.96; %H, 8.43; %N, 8.63.

EXAMPLE II

This example describes the general method of preparing the inventive bis(disubstituted aminomethyl) phenols. The same general procedure as described in Example I was followed with the exception that about twice the amount of formaldehyde and dialkyl amine was used. The following table summarizes the preparation and products relating to these bis derivatives.

TABLE I

| Bis(Dialkylaminomethyl) Phenols | | | | | | | | | | | |
|---|---|---|---|---|---|---|---|---|---|---|---|
| Ingredients | | | | | | | Product | | | | |
| Sub. Phenol | | Amine | | Formaldehyde[a] | | Water | | | Elemental Analysis | | |
| Grams | Moles | Grams | Moles | Grams | Moles | Grams | Compound | B.P. °C. | % C | % H | % N |
| 75 | 0.5 | 54 | 1.2 | 66 | 2.2 | 162 | 2,4-Bis(dimethylamino-methyl)-6-tert-butylphenol | 87/.1 torr | 72.68<br>72.54 | 10.67<br>10.90 | 10.59 Calc'd<br>9.22 Found |
| 68 | 0.5 | 54 | 1.2 | 62 | 2.1 | 81 | 2,4-Bis(dimethylamino-methyl)-6-isopropylphenol | 94/.05 torr | 71.96<br>71.65 | 10.47<br>10.45 | 11.18 Calc'd<br>10.10 Found |
| 75 | 0.5 | 54 | 1.2 | 66 | 2.2 | 81 | 2,6-Bis(dimethylamino-methyl)-4-tert-butylphenol | 124/.2 torr | 72.68<br>72.73 | 10.67<br>10.70 | 10.59 Calc'd<br>10.35 Found |
| 68 | 0.5 | 54 | 1.2 | 66 | 2.1 | 81 | 2,6-Bis(dimethylamino-methyl)-4-isopropyl)phenol | 110/.15 torr | 71.96<br>71.37 | 10.47<br>10.46 | 11.18 Calc'd<br>11.13 Found |
| 23.5 | 0.25 | 73 | 1.0 | 32 | 1.0 | 219 | 2,4-Bis(diethylamino-methyl)phenol | 130/.05 torr | 72.68<br>72.40 | 10.67<br>10.97 | 10.59 Calc'd<br>10.58 Found |

[a]Used as a 37% aqueous solution.

EXAMPLE III

This example illustrates the use of bis(disubstituted aminomethyl) phenols as antioxidants in unleaded gasoline. The results which are listed in Table II show that, in general, it is necessary to dissolve only a small amount of the bis(disubstituted aminomethyl) phenol (5 ppm or 0.0005 weight percent) in unleaded gasoline to give good oxygen stability to the fuel. In most cases the bis(disubstituted aminomethyl) phenols gave better antioxidant performance than N,N'-di-sec-butylphenylenediamine (AO-22) and almost as good as tri(-substituted aminomethyl)phenol, 2,4,6-tris(dimethylaminomethyl)phenol both antioxidants of known value. The inventive bis derivatives performed as well as some corresponding mono(disubstituted aminomethyl) phenols. ASTM D 525-74 "Oxidation Stability of Gasoline (Induction Period Method)", was the standard test used for determining oxidation stability (oxygen resistance). Briefly, the method consists of dissolving 0.2 grams of the additive to be tested in 1000 milliliters of unleaded gasoline and diluting 1 milliliter of this solution with 433 milliliters of the same gasoline. This is equivalent to about 0.0005 weight percent (5 ppm) or 1.4 pounds of additive per 1000 barrels of gasoline. Fifty milliliters of the gasoline containing 5 ppm additive was placed in a glass sample containor which was positioned in a steel bomb. The bomb was sealed, pressured to 100 to 102 psig (689 to 703 kPa) with oxygen and placed in a 208°-216° F. (98°-102° C.) water bath. The time was noted for a 2 psig (13.8 kPa) pressure drop within a 15 minute interval.

TABLE II

| Bis(Disubstituted Aminomethyl) Phenols as Antioxidants in Unleaded Gasoline[a] | |
|---|---|
| 0.0005 Wt. % (5 ppm) Additive | Time for 2 psig (13.8 kPa) Pressure Drop within a 15 Minute Interval |
| Controls | |
| 1. No additive | 2 hrs. 41 mins. |
| 2. AO-22 (N,N'-di-sec-butyl-phenylenediamine) | 3 hrs. 48 mins. |
| 3. 2,4,6-Tris(dimethylaminomethyl) phenol | 4 hrs. 15 mins. |
| 4. 2-(Dimethylaminoethyl)phenol | 4 hrs. 10 mins. |
| 5. 2-(Dimethylaminomethyl)-4-tert-butylphenol | 4 hrs. 0 mins. |
| Inventive Compounds | |
| 6. 2,4-Bis(dimethylaminomethyl)-6-tert-butylphenol | 4 hrs. 0 mins. |
| 7. 2,4-Bis(dimethylaminomethyl)-6-isopropylphenol | 3 hrs. 50 mins. |
| 8. 2,6-Bis(dimethylaminoethyl)-4-tert-butylphenol | 3 hrs. 30 mins. |

TABLE II-continued

| Bis(Disubstituted Aminomethyl) Phenols as Antioxidants in Unleaded Gasoline[a] | |
|---|---|
| 0.0005 Wt. % (5 ppm) Additive | Time for 2 psig (13.8 kPa) Pressure Drop within a 15 Minute Interval |
| 9. 2,6-Bis(dimethylaminomethyl)-4-isopropylphenol | 3 hrs. 55 mins. |
| 10. 2,4-Bis(diethylaminomethyl) phenol | 4 hrs. 0 mins. |

[a]Unleaded Kansas City premium pipeline base gasoline (FT-116) which contains 15-16 wt. % olefins available from Phillips Petroleum Co.
[b]ASTM D525-74.

We claim:

1. An ashless hydrocarbon fuel composition comprising a gasoline-containing hydrocarbon fuel for an internal combustion engine and bis(disubstituted aminomethyl)phenol corresponding to the formula

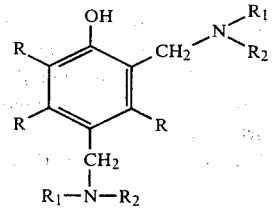

wherein R is hydrogen or an alkyl radical having 1 to 6 carbon atoms, $R_1$ and $R_2$ are alkyl radicals having 1 to 6 carbon atoms with the proviso that $R_1$ and $R_2$ taken together can be any alkylene or alkylene ether radical having 4 to 6 carbon atoms.

2. An ashless hydrocarbon fuel composition of claim 1 wherein R is hydrogen.

3. An ashless hydrocarbon fuel composition of claim 1 wherein at least one R is alkyl.

4. An ashless hydrocarbon fuel composition of claims 1, 2, or 3 wherein said bis(disubstituted aminomethyl)-phenol is present in a concentration of about 0.0001 to about 1 weight percent of the total composition.

5. An ashless lubricating composition comprising a lube stock and bis(disubstituted aminomethyl)phenol corresponding to the formula

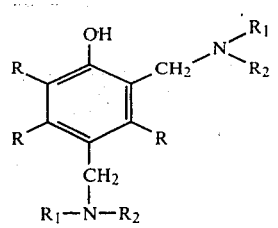

wherein R is hydrogen or an alkyl radical having 1 to 6 carbon atoms, $R_1$ and $R_2$ are alkyl radicals having 1 to 6 carbon atoms with the proviso that $R_1$ and $R_2$ taken together can be any alkylene or alkylene ether radical having 4 to 6 carbon atoms.

6. An ashless lubricating composition of claim 5 wherein R is hydrogen.

7. An ashless lubricating composition of claim 5 wherein at least one R is alkyl.

8. An ashless lubricating composition of claim 5, 6, or 7 wherein said bis(disubstituted aminomethyl)phenol is present in a concentration of about 0.01 to about 10 weight percent of the total composition.

9. A method for producing an ashless hydrocarbon fuel composition comprising the addition to a gasoline-containing hydrocarbon fuel for an internal combustion engine of an amount of bis(disubstituted aminomethyl)-phenol sufficient to act as an oxidation stabilizer for the composition, said bis(disubstituted aminomethyl)phenol corresponding to the formula

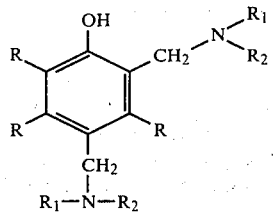

wherein R is hydrogen or an alkyl radical having 1 to 6 carbon atoms, $R_1$ and $R_2$ are alkyl radicals having 1 to 6 carbon atoms with the proviso that $R_1$ and $R_2$ taken together can be any alkylene or alkylene ether radical having 4 to 6 carbon atoms.

10. A method of claim 9 wherein R is hydrogen.

11. A method of claim 9 wherein at least one R is alkyl.

12. A method for producing an ashless lubricating composition comprising admixing with a lube stock an amount of bis(disubstituted aminomethyl)phenol sufficient to act as an oxidation stabilizer for the composition, said bis(disubstituted aminomethyl)phenol corresponding to the formula

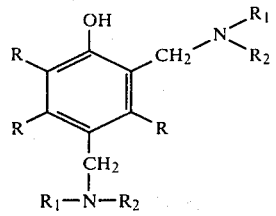

wherein R is hydrogen or an alkyl radical having 1 to 6 carbon atoms, $R_1$ and $R_2$ are alkyl radicals having 1 to 6 carbon atoms with the proviso that $R_1$ and $R_2$ taken together can be any alkylene or alkylene ether radical having 4 to 6 carbon atoms.

13. A method of claim 12 wherein R is hydrogen.

14. A method of claim 12 wherein at least one R is alkyl.

15. A composition of matter of claim 12 chosen from among 2,4-bis(dimethylaminomethyl)-6-tert-butylphenol, 2,4-bis(dimethylaminomethyl)-6-isopropylphenol, and 2,4-bis(diethylaminomethyl)phenol.

16. A composition of matter comprising bis(disubstituted aminomethyl)phenol of the formula

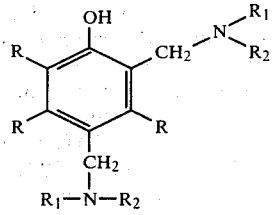

wherein R is hydrogen or an alkyl radical having 1 to 6 carbon atoms, $R_1$ and $R_2$ are alkyl radicals having 1 to 6 carbon atoms with the proviso that $R_1$ and $R_2$ taken together can be any alkylene or alkylene ether radical having 4 to 6 carbon atoms.

* * * * *

UNITED STATES PATENT AND TRADEMARK OFFICE

CERTIFICATE OF CORRECTION

PATENT NO. : 4,322,304

DATED : March 30, 1982

INVENTOR(S) : Robert M. Parlman and Lyle D. Burns

It is certified that error appears in the above-identified patent and that said Letters Patent are hereby corrected as shown below:

Claim 15, line 1, delete "12" and substitute therefor --- 16 ---.

Signed and Sealed this

*Eighteenth* Day of *June 1985*

[SEAL]

*Attest:*

DONALD J. QUIGG

*Attesting Officer* *Acting Commissioner of Patents and Trademarks*